US005833112A

United States Patent [19]

Pape et al.

[11] Patent Number: 5,833,112

[45] Date of Patent: Nov. 10, 1998

[54] POURING SPOUT ATTACHMENT

[75] Inventors: Leslie Pape, Novi; Barry C. Owen, Southfield, both of Mich.

[73] Assignee: Elopak Systems AG, Glattbrugg, Switzerland

[21] Appl. No.: 914,886

[22] Filed: Aug. 19, 1997

Related U.S. Application Data

[63] Continuation of Ser. No. 464,338, Jun. 5, 1995, abandoned.

[51] Int. Cl.[6] ..... B65D 51/22

[52] U.S. Cl. ..... 220/258; 220/259; 220/335; 222/541.2; 222/541.5; 222/541.6

[58] Field of Search ..... 215/235, 253, 215/298, 301, 305; 220/258, 259, 335; 222/541.2, 541.5, 541.6

[56] References Cited

U.S. PATENT DOCUMENTS

| | | | |
|---|---|---|---|
| 3,871,552 | 3/1975 | Irland et al. . | |
| 3,912,128 | 10/1975 | Ziemann et al. . | |
| 3,924,777 | 12/1975 | Peyser . | |
| 3,938,693 | 2/1976 | Patel et al. . | |
| 4,489,864 | 12/1984 | Davis . | |
| 4,553,684 | 11/1985 | Bennett . | |
| 4,600,127 | 7/1986 | Malpas et al. . | |
| 4,669,640 | 6/1987 | Ando et al. . | |
| 4,760,931 | 8/1988 | Gach . | |
| 4,795,065 | 1/1989 | Ashizawa et al. . | |
| 4,813,578 | 3/1989 | Gordon et al. . | |
| 4,892,217 | 1/1990 | Shastal . | |
| 4,903,865 | 2/1990 | Janowitz | 222/541.6 |
| 4,915,290 | 4/1990 | Robichaud et al. . | |
| 4,925,034 | 5/1990 | Robichaud et al. . | |
| 4,934,590 | 6/1990 | Robichaud et al. . | |
| 4,948,015 | 8/1990 | Kawajiri et al. . | |
| 4,964,562 | 10/1990 | Gordon . | |
| 4,988,012 | 1/1991 | Shastal . | |
| 5,088,643 | 2/1992 | Frazier et al. . | |
| 5,101,999 | 4/1992 | Robichaud et al. . | |
| 5,133,486 | 7/1992 | Moore et al. . | |
| 5,292,025 | 3/1994 | Dubreul . | |

FOREIGN PATENT DOCUMENTS

| | | |
|---|---|---|
| 0577867 | 1/1994 | European Pat. Off. . |
| 2267896 | 12/1993 | United Kingdom . |

*Primary Examiner*—Stephen K. Cronin
*Attorney, Agent, or Firm*—Reising, Ethington, Learman & McCulloch, PLLC

[57] ABSTRACT

A pouring spout attachment adapted to being applied to a pourable-product-carrying container over a location where the container has one of a partial depth cut and an opening formed therein. The pouring spout attachment includes a body and may have a removable cap mounted thereon. The body includes an internal projection, an external mounting flange, and an internal end wall having a web segment cut therein so as to be movable about a pivot or hinge line, and a projection formed on the web segment, such that upon the web segment being pivoted inwardly, the projection is pivoted so as to snap past the internal projection to retain a fully open condition.

24 Claims, 3 Drawing Sheets

FIG. 1
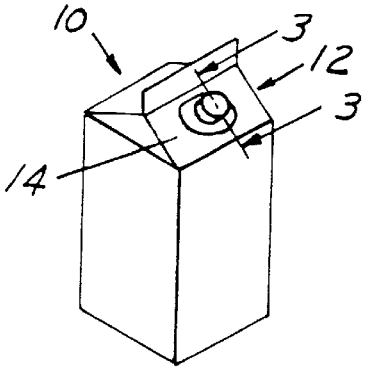
FIG. 2
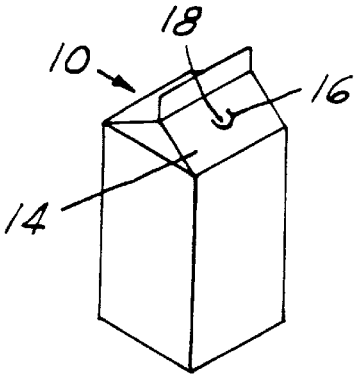
FIG. 3
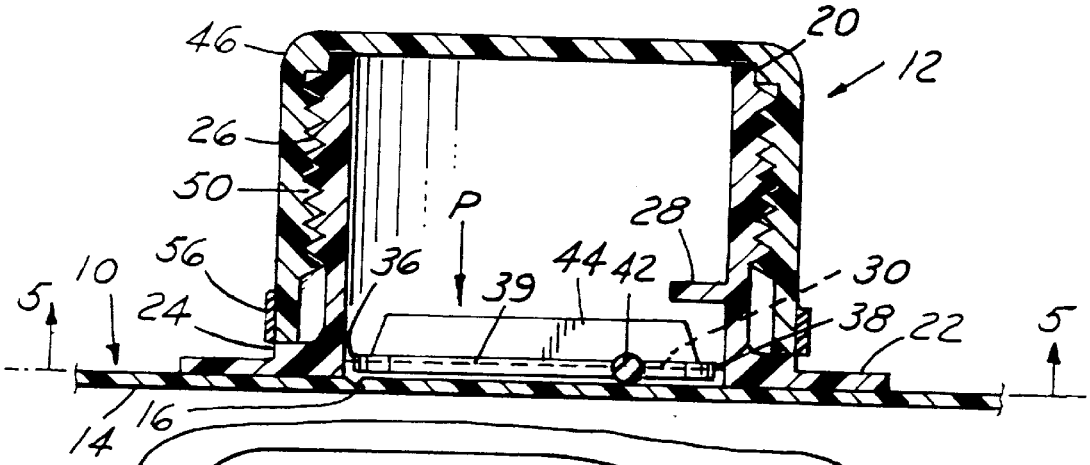
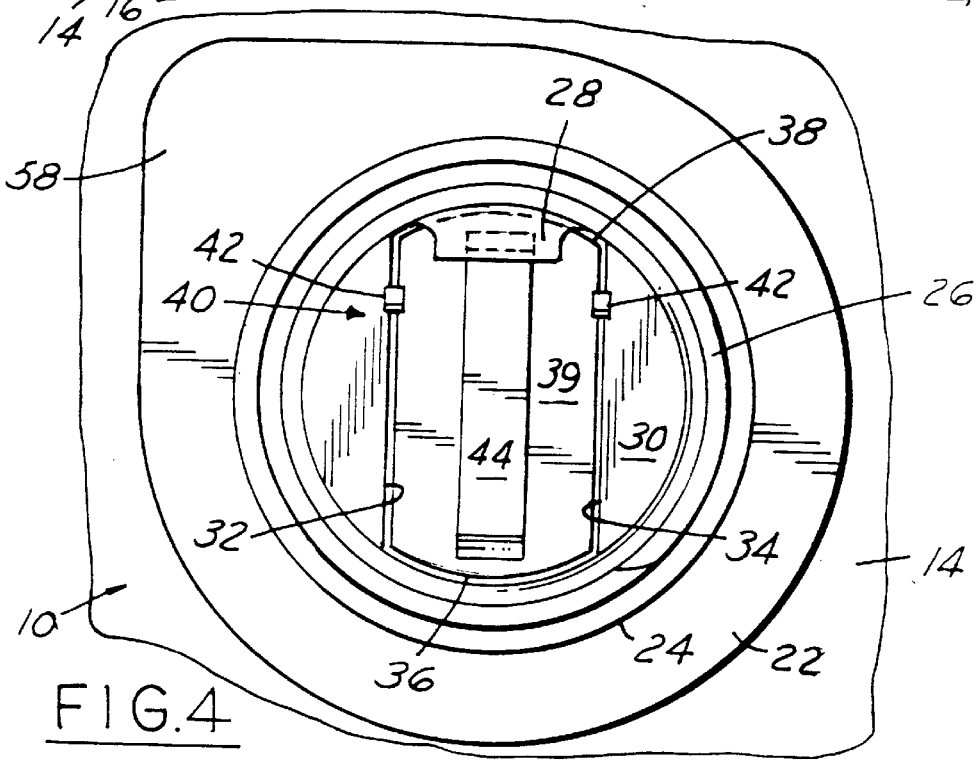
FIG. 4

POURING SPOUT ATTACHMENT

This is a continuation of application Ser. No. 08/464,338, filed on Jun. 5, 1995 now abandoned.

TECHNICAL FIELD

This invention relates generally to pouring devices for containers and, more particularly, to spout attachments for liquid-carrying cartons.

BACKGROUND ART

Heretofore, pouring spout attachments have been used on liquid-carrying containers. Such attachments mounted on an outside carton surface are shown and described in U.S. Pat. Nos. 5,088,643; 4,813,578; and 4,964,562. Attachments having flanges secured on inside surfaces and extending out through openings in a container panel include U.S. Pat. Nos. 4,948,015; 4,795,065; and 4,669,640, each of which includes a pull tab. U.S. Pat. Nos. 5,292,025 and 4,600,127 disclose attachments having rotatable members having tapered ends for breaking rupturable, tapered panel segments when rotated and depressed.

Push-in tabs for breaking weakened panel zones in order to open containers are disclosed in U.S. Pat. Nos. 5,101,999; 4,934,590; 4,925,034; 4,892,217; 3,938,693; 3,924,777; and 3,871,552.

U.S. Pat. No. 4,934,590 discloses a package including a lever having a forward portion and a rearward portion, and a U-shaped lip having oppositely disposed locking arms, wherein the forward portion is pushed downwardly, breaking a frangible connection and pivoting the rearward portion upwardly. Pivoting of the lever is continued until the rearward portion is locked by an interference fit with an edge of the lip and, additionally, pressed below the locking arms to provide a one-way locking means.

DISCLOSURE OF THE INVENTION

A general object of the invention is to provide an improved pouring device for containers having partial depth cuts or openings formed in an outer surface thereof.

Another object of the invention is to provide an improved pouring spout attachment which is applied to the outside of a selected container panel, and includes a push-in opening arrangement operable in conjunction with a provision for retaining the pushed-in segment in its fully open condition.

Still another object of the invention is to provide a pouring spout attachment for a container having a U-shaped or C-shaped cut formed partially through a selected panel thereof, and including an integrally molded body with a projection formed on the inner wall thereof and a mounting flange formed on the lower end thereof enclosing a central bottom web having oppositely disposed U-shaped or C-shaped cuts formed therethrough, one of these being substantially aligned with the partial cut in the container panel, a pivot or hinge line formed by the omission of a cut between the oppositely disposed U-shaped or C-shaped cuts, such that by pushing down on the central bottom web segment defined by the one U-shaped or C-shaped cut the underlying partial cut in the container panel is broken, and, in a fulcrum and lever fashion, the pivoting of that segment causes the central bottom web segment defined by the other U-shaped or C-shaped cut to snap past the projection and be retained thereby.

A still further object of the invention is to provide a pouring spout attachment body adapted to receiving a screw-on cap, or alternately, a snap-on cap.

Still another object of the invention is to provide a pouring spout attachment for a container having an opening formed in a selected panel thereof, and including a body with a shoulder or projection formed on the inner wall thereof and a mounting flange on the lower end thereof, and a cover web on the upper end thereof, partially cut perforations formed between the cover web and the body for approximately two-thirds of the periphery thereof, a hinge line formed laterally across the cover web, an inwardly extending projection formed on the cover web adjacent the hinge line, a shoulder formed on the inner surface of the body defining a retaining pocket with the cover web for retaining the projection upon the latter being snapped past the shoulder when the cover web is pushed inwardly, breaking the perforations.

These and other objects and advantages will become more apparent when reference is made to the following drawings and the accompanying description.

BRIEF DESCRIPTION OF THE DRAWINGS

FIG. 1 is a perspective view of a liquid-carrying container embodying the inventive pouring spout attachment;

FIG. 2 is a perspective view of the FIG. 1 container having a partial depth cut formed therein prior to having the pouring spout attachment secured thereon;

FIG. 3 is an enlarged cross-sectional view taken along the plane of the line 3—3 of FIG. 1, and looking in the direction of the arrows;

FIG. 4 is a top view of the FIG. 3 structure, with the end cap removed;

BEST MODE FOR CARRYING OUT THE INVENTION

Figure 5:
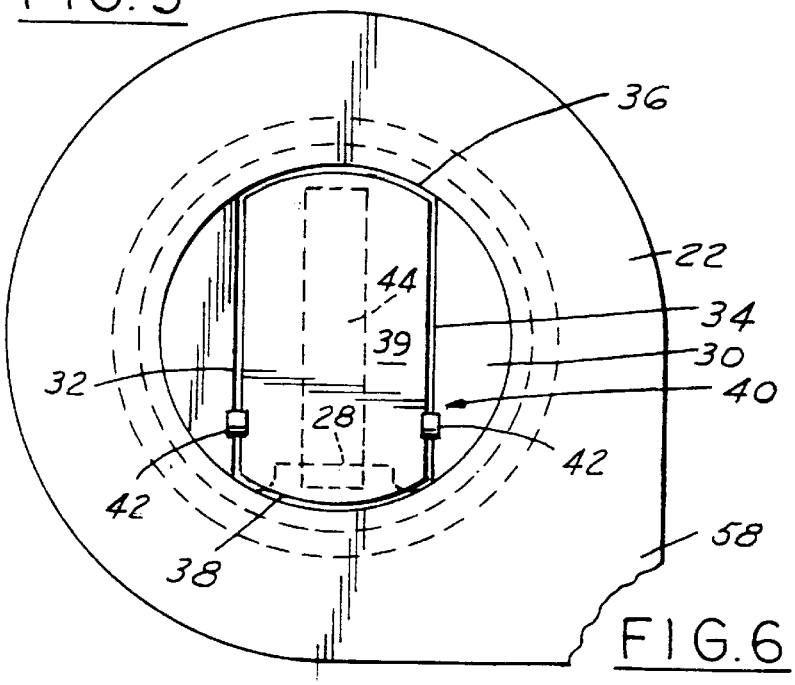
FIG. 5 is a bottom view of the FIG. 3 structure taken along the plane of the line 5—5, and looking in the direction of the arrows.

Referring now to the drawings in greater detail, FIG. 1 illustrates a carton 10 including a pouring spout attachment 12 mounted on an upper panel 14 thereof. Prior to mounting the spout attachment 12 on the panel 14, as shown in FIG. 2, a U-shaped partial depth cut 16 is made on the panel formed in any suitable manner, such as by either a laser or a die. The partial depth cut 16 defines a panel segment 18.

The pouring spout attachment 12 is illustrated more specifically in FIGS. 3–5 as including a cylindrical body 20 having a mounting flange 22 formed thereon, secured to the panel 14 surrounding the periphery of the U-shaped cut 16. A shoulder 24 is formed adjacent the flange 22. Threads 26 are formed around the outer surface of the cylindrical body 20. A tang or projection or detent element 28 of a predetermined width is formed on the inner surface of the body 20 at a predetermined height therein.

Molded as an integral end wall of the FIGS. 3–5 structure inward of the mounting flange 22 is a web 30 having cuts formed therethrough consisting of parallel sides 32 and 34, with arcuate ends 36 and 38, defining a web or flap or end segment 39. A pivot or hinge line 40 is formed by virtue of oppositely disposed thicker molded segments 42 remaining uncut at a predetermined location along the sides 32 and 34, forming the end wall segment into forward and rearward portions. A rib 44 is formed on the panel segment 39 along the longitudinal center line thereof. The spout attachment 12 is seated on the carton panel 14, with the cut edges 32, 34 and 36 positioned adjacent the U-shaped cut 16.

An internally threaded cap 46 is threadedly mounted on the external threads 26, abutting against the shoulder 24.

Figure 7:
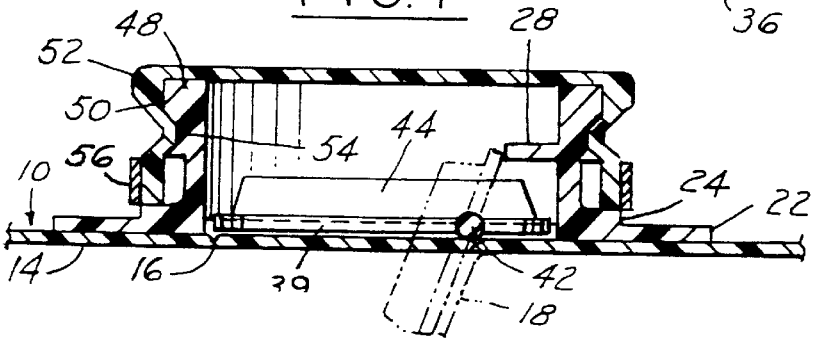
FIG. 7 is a view similar to FIG. 3, illustrating an alternate embodiment of the body and end cap portions of the invention.
Figure 8:
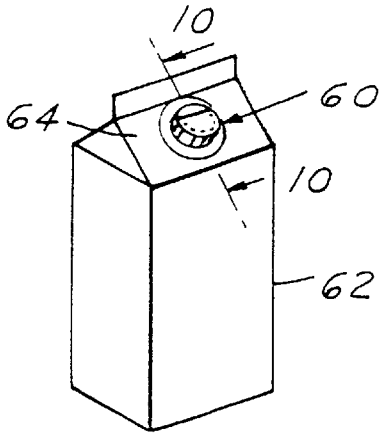
FIG. 8 is a perspective view similar to FIG. 1 but of a modified embodiment of the container and the pouring spout attachment.
Figure 9:
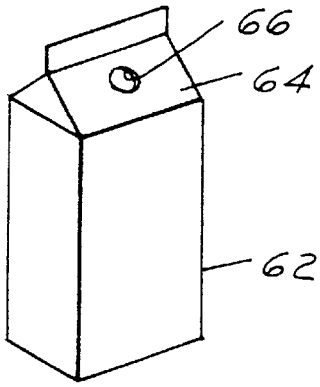
FIG. 9 is a perspective view of the FIG. 8 embodiment of the container showing an opening formed in a top panel thereof.

An alternate embodiment is shown in FIG. 7, as including a shorter cylindrical body 48 than the above referenced body 20, with the same mounting flange 22 and adjacent shoulder 24. An annular outwardly protruding annular bead 50 is formed adjacent the upper end of the body 48. A snap cap 52 includes an inwardly extending annular ridge 54 formed a predetermined distance below the top end thereof. The predetermined distance is such that the internal ring 54 is adapted to snap over the external bead 50 of the body 48, to seat the cap 52 on the shoulder 24.

A tamper evident full-round strip 56 is formed around either the threaded cap 46 or the snap cap 52, just above the shoulder 24.

An optional tab 58 or like means may be formed on a selected edge portion of the mounting flange 22 to facilitate the proper orientation of the cut 32, 34 and 36 directly over the partial depth cut 16 on the container panel 14.

Figure 6:
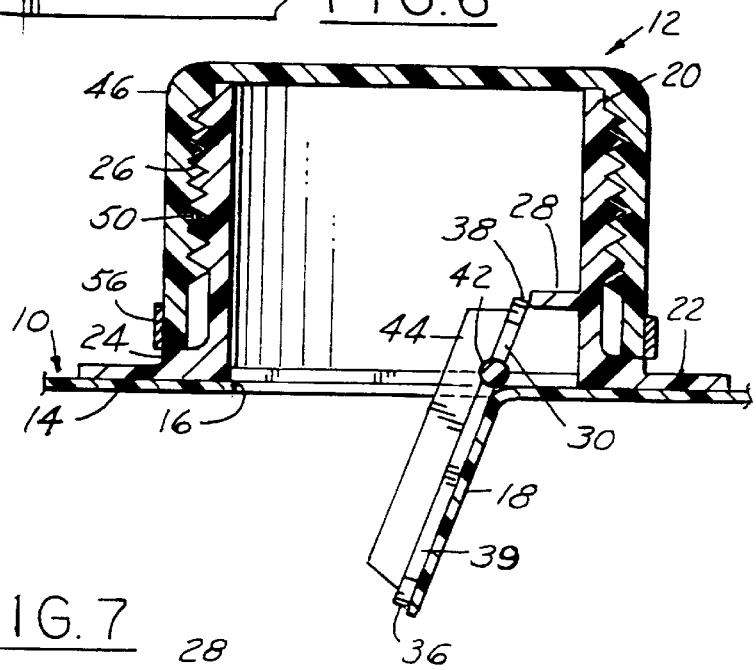
FIG. 6 is a view of the FIG. 3 structure illustrating a different operational condition.

In operation, after the carton 10 is filled and sealed in the usual manner, the pouring spout attachment 12 is opened as shown in FIG. 6 as follows:

The tamper evident ring 56 is broken. The screw cap 46 is then threadedly removed from the threaded body 20. (In the case of the alternate embodiment, the snap cap 52 is pried off the bead 50 of the body 48.)

Thereafter, downward force is applied to the rib 44 at the point P (FIG. 3). Such force causes the web segment 39 to pivot downwardly in a counterclockwise movement about the pivot 40, breaking the remaining thickness beneath the cut 16 of the carton panel 14, around the carton panel segment 18. The counterclockwise movement about the pivot 40 is such that the portion of the web segment 39 defined by the cuts 32, 34 and 38 is pivoted upwardly until the end 38 snaps past the projection 28, to thereby retain the web segment 39 in the fully open position.

Any closure thereafter, before the carton's contents are emptied, is by replacing the screw cap 46 or the snap cap 52, with the enclosed rib 44, web segment 39, and carton panel segment 18 retained in the open condition.

Referring now to FIGS. 8–11, a further embodiment of a pouring spout attachment 60 (FIG. 8) for a carton 62 is disclosed. Prior to mounting the spout attachment on an upper panel 64, an opening 66 (FIG. 9) is formed in the panel.

Figure 10:
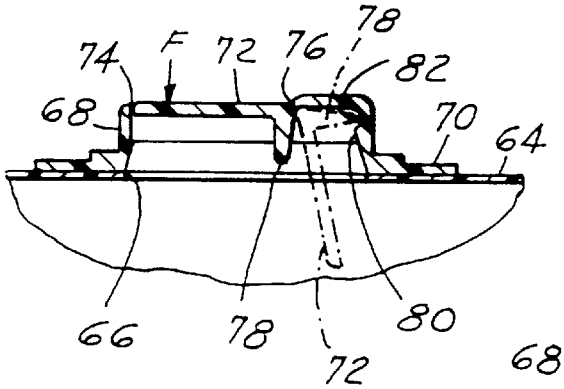
FIG. 10 is an enlarged cross-sectional view taken along the plane of the line 10—10 of FIG. 8, and looking in the direction of the arrows.
Figure 11:
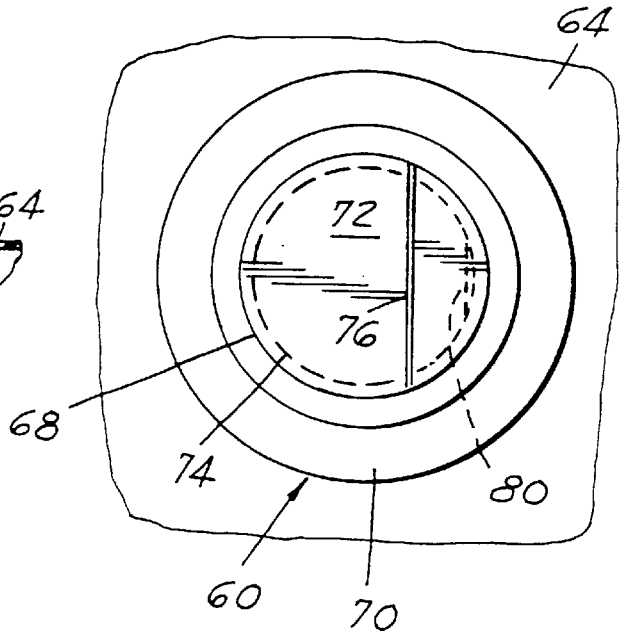
FIG. 11 is a top view of the FIG. 10 embodiment.

The pouring spout attachment 60, as more clearly shown in FIG. 10, includes a cylindrical body 68 having an outer mounting flange 70 formed thereon, secured to the panel 64 surrounding the periphery of the opening 66. A cover web or inner body in the form of a flap 72 is integrally formed on the upper end of the cylindrical body 68.

Partial death cuts 74 (FIG. 11) form a common edge between the cover web 72 and the body 68 for approximately two-thirds of the periphery thereof. A score line or stepped ed e forms a flexible hinge 76 (FIG. 11) laterally across the cover web 72 between the ends of the perforations 74.

A downwardly ex ending projection 78 (FIG. 10) is formed on the inn surface of the cover web 72 on the perforation side f the flexible hinge 76. A second projection or shoulder 80 forms a detent and defines a retaining pocket 82 on the inner surface of the cylindrical body 68 directly opposite the center of the perforations 74.

In operation, the pouring spout attachment 60 is opened by manually pressing down on the cover web 72 at the center of the perforations 74, as shown by the arrow F in FIG. 10. Once the major portion of the cover web 72 reaches a substantially vertical attitude, as shown in phantom in FIG. 10, the projection 78 will have snapped past the shoulder 80 to become confined in the retaining pocket 82 and, thus, retaining the flap 72/78 in an open condition.

Industrial Applicability

It should be a parent that the invention provides an improved pouring spout attachment for a liquid-carrying container which may be readily forced inwardly while automatically providing an interference engagement of two components which retain the spout in an open condition.

It should be further apparent that the flap which provides a fulcrum and lever or seesaw effect of opening at one inwardly forced end and causing an interference connection at the other outwardly projecting end may have it outer surface formed on the same plane as that of the external mounting flange.

It should be still further apparent that the pouring spout attachment of the present invention is substantially simpler and more compact than prior art arrangements, such as U.S. Pat. No. 4,934,590 referred to above.

While but one primary embodiment of the invention, and two secondary embodiments have been shown and described, other modifications thereof are possible within the scope of the following claims.

What is claimed is:

1. For use on a pourable product-carrying container having one of (a) a partial depth/non-linear cut, and (b) an opening, formed in a selected panel thereof, a pouring spout attachment including a body around an integral web segment and said body adapted to being secured on said selected panel around one of said partial depth/non-linear cut and said opening, and a hinge line formed across said integral web segment, characterized by one of a (c) through-cut and (d) partial depth cut formed between adjacent peripheral edges of said integral web segment and said body, a first projection formed on said inner surface of said body such that, upon said integral web segment being pivoted into the container about said hinge line through one of said partial depth/non-linear cut and said opening, the first projection snaps upwardly past the second projection to retain the integral web segment in an open condition.

2. The pouring spout attachment described in claim 1, wherein said first projection is inclined toward one of said partial depth/non-linear cut and said opening, and said second projection defines a retaining pocket for retaining said first projection upon pivoting of said integral web segment about said hinge line.

3. The pouring spout attachment described in claim 1, wherein said first projection is on the same plane as said integral web segment, and the pivoting of said integral web segment serves to break said partial depth/non-linear cut in said selected container panel.

4. The pouring spout attachment described in claim 1, and an end cap cooperatively connected to said body.

5. For use on a pourable product-carrying container having a partial depth cut formed in a selected panel thereof defining a panel segment with a transverse connection between the ends of said partial depth cut, a pouring spout attachment adapted to being secured thereon for cooperation with the panel segment, the pouring spout attachment including a body having an external flange formed on an end portion thereof and adapted to being affixed on said selected panel around said partial depth cut, and an end wall integrally formed within the end portion, characterized by first and second cuts formed through said end wall with said first cut substantially aligned with said partial depth cut and defining an end all segment with a hinge connection between adjacent ends of said first and second cuts forming forward and rearward portions of said end wall segment, a detent element formed on the inner surface of said body, and said detent element and said rearward portion of said end wall segment adapted to become interlocked when said forward portion of said end wall segment and said panel segment are pivoted inwardly about said respective hinge and transverse connections to thereby lift said rearward portion upwardly past said detent element.

6. The pouring spout attachment described in claim 5, characterized by said detent element being a projection from said inner surface of said body, and said hinge connection providing a pivot portion between said forward and rearward portions.

7. The pouring spout attachment described in claim 6, wherein said end wall defined by said first and second cuts is adapted to pivot about said hinge connection when a downward farce is applied adjacent the first cut end of the web segment, causing the further cut end of the end wall to be pivoted upwardly about said pivot portion in a fulcrum and lever effect to snap past said internal projection and be retained thereby.

8. A pouring attachment for attaching to a wall of a container, comprising an inner body in the form of a flap, an outer body bounding a pouring zone and extending around said flap, and hinge means nearer one side of said pouring zone than the opposite side of said pouring zone, and mounting said flap in said outer body for turning, about an axis extending transversely of said outer body, between a flow-obturating position in said pouring zone and a flow-enabling position, and a detent on said outer body characterized in that said detent is nearer said one side than said opposite side and said flap has an upwardly pivotable portion adapted to engage said detent, whereby said flap is retained in said flow-enabling position following turning of said flap from said flow-obturating position to said flow-enabling position.

9. An attachment according to claim 8, wherein a through-cut is formed between adjacent inner and outer peripheral edges of said outer body and said flap, respectively.

10. An attachment according to claim 8, wherein a partial-depth cut is formed between adjacent inner and outer peripheral edges of said outer body and said flap, respectively.

11. An attachment according to claim 8, wherein said flap comprises a major part at one side of said axis and a minor part at another side of said axis and wherein said minor part serves to engage said detent on its upward movement to retain said flap in said flow-enabling position.

12. An attachment according to claim 11, wherein said minor part is substantially co-planar with said major part.

13. An attachment according to claim 11, wherein said minor part is inclined to said major part.

14. An attachment according to claim 13, wherein said outer body includes a pocket defined by said detent and serving to receive said minor part in said flow-enabling position of said flap.

15. An attachment according to claim 14, wherein said outer body includes a tubular part encircling said pouring zone and closed at one end by a web comprised of said major part and a wall of said pocket, said hinge means being at a junction between said major part and said wall of said pocket, and a line of weakness extending along a junction between said tubular part and said major part and being frangible to permit turning of said flap about said hinge means from said flow-obturating position towards said flow-enabling position.

16. A combination comprising:

(i) a container having a wall, and (ii) a pouring device at the outside of said wall and comprising an inner body in the form of a flap, an outer body bounding a pouring zone and extending around said flap, which occupies a flow-obturating position in said pouring zone, hinge means nearer one side of said pouring zone than the opposite side of said pouring zone, and mounting said flap in said outer body for turning about an axis extending transversely of said outer body, between said flow-obturating position in said pouring zone and a flow-enabling position, and a detent on said outer body, characterized in that said detent is nearer said one side than said opposite side and said flap has an upwardably pivotable portion adapted to engage said detent, whereby said flap is retained in said flow-enabling position following turning of said flap from said flow-obturating position to said flow-enabling position.

17. A combination according to claim 16, wherein a through-cut is formed between adjacent inner and outer peripheral edges of said outer body and said flap, respectively, and a weakened, but imperforate, portion of said wall is present in said pouring zone.

18. A combination according to claim 16, wherein a partial-depth cut is formed between adjacent inner and outer peripheral edges of said outer body and said flap, respectively, and an opening is formed through said wall in said pouring zone.

19. A combination according to claim 16, wherein said flap comprises a major part at one side of said axis and a minor part at another side of said axis and wherein said minor part serves to engage said detent on its upward movement to retain said flap in said flow-enabling position.

20. A combination according to claim 19, wherein said minor part is substantially co-planar with said major part.

21. A combination according to claim 19, wherein said minor part is inclined to said major part.

22. A combination according to claim 21, wherein said outer body includes a pocket defined by said detent and serving to receive said minor part in said flow-enabling position of said flap.

23. A combination according to claim 22, wherein said outer body includes a tubular part encircling said pouring zone and closed at its outer end by a web comprised of said major part and a wall of said pocket, said hinge means being at a junction between said major part and said wall of said pocket, and a line of weakness extending along a junction between said tubular part and said major part and being frangible to permit turning of said flap about said hinge means from said flow-obturating position towards said flow-enabling position.

24. A pouring attachment for attaching to a wall of a container, comprising an inner body in the form of a flap, an outer body surrounding a pouring zone and extending around said flap, and hinge means nearer one side of said pouring zone than the opposite side of said pouring zone, and mounting said flap and said hinge means within said outer body for turning about an axis of said hinge means extending transversely of said outer body, between a flow-obturating position in said pouring zone and a flow-enabling position, and a detent formed on said outer body nearer one end than the opposite end of said pouring zone, and said flap has a portion adjacent said one end of said pouring zone adapted to engage said detent on said outer body, whereby said flap is retained in said flow-enabling position following turning of said flap from said flow-obturating position to said flow-enabling position.

* * * * *

UNITED STATES PATENT AND TRADEMARK OFFICE

CERTIFICATE OF CORRECTION

PATENT NO. : 5,833,112

DATED : Nov. 10, 1998

INVENTOR(S) : Leslie Pape, Barry C. Owen

It is certified that error appears in the above-identified patent and that said Letters Patent is hereby corrected as shown below:

Column 3, lines 6 and 7, between "end" and "segment", insert --wall--.

Column 4, line 46, between "opening" and "formed", delete --,--.

Column 4, line 54, between "said" and "inner", insert --integral web segment, and a second projection formed on an--.

Signed and Sealed this

Fourth Day of May, 1999

*Attest:*

Q. TODD DICKINSON

*Attesting Officer*

*Acting Commissioner of Patents and Trademarks*